United States Patent [19]

Hoyt, Jr.

[11] Patent Number: 4,826,174

[45] Date of Patent: May 2, 1989

[54] PUTTING PRACTICE DEVICE

[76] Inventor: Dolph G. Hoyt, Jr., 162 Ashdale Ave., Los Angeles, Calif. 90049

[21] Appl. No.: 91,526

[22] Filed: Aug. 31, 1987

Related U.S. Application Data

[62] Division of Ser. No. 922,705, Oct. 24, 1986, Pat. No. 4,725,063.

[51] Int. Cl.[4] ..... A63B 69/36

[52] U.S. Cl. ..... 273/186 R; 273/192

[58] Field of Search ..... 273/177 R, 186 R, 191 R, 273/192, 186 B, 186 C, 183 A

[56] References Cited

U.S. PATENT DOCUMENTS

| | | | |
|---|---|---|---|
| 2,473,680 | 6/1949 | Farris | 273/177 R |
| 3,194,565 | 7/1965 | Schroer | 273/186 R |

*Primary Examiner*—George J. Marlo
*Attorney, Agent, or Firm*—Whann & Connors

[57] ABSTRACT

A device used to practice putting including a putting station and a remote target station. The putting station comprises a mat on which two parallel rows of posts are provided which straddle parallel strips that serve as guides for the putting head. The number of posts in each row may be the same or different. If there is an unequal number of posts, an entry way and an exit way is provided through which the club head may be moved by the golfer when swinging at the ball. The target station includes a body member having two ramps which lead to a collector section. One ramp serves as an entry ramp and target. The other ramp serves as an exit ramp to allow the ball to move under the force of gravity from the collector section. The collector section includes a lip which acts as a stop to prevent the ball from rolling beyond the target station if it is moving at the desired speed, but will allow the ball to roll over it if it is moving at an excessive speed. The putting station has three variations using pairs of posts straddling a ball position marker. The rows of posts may be unequal to allow for an inside to outside swing. The posts may also be both behind or even with the ball position marker.

8 Claims, 4 Drawing Sheets

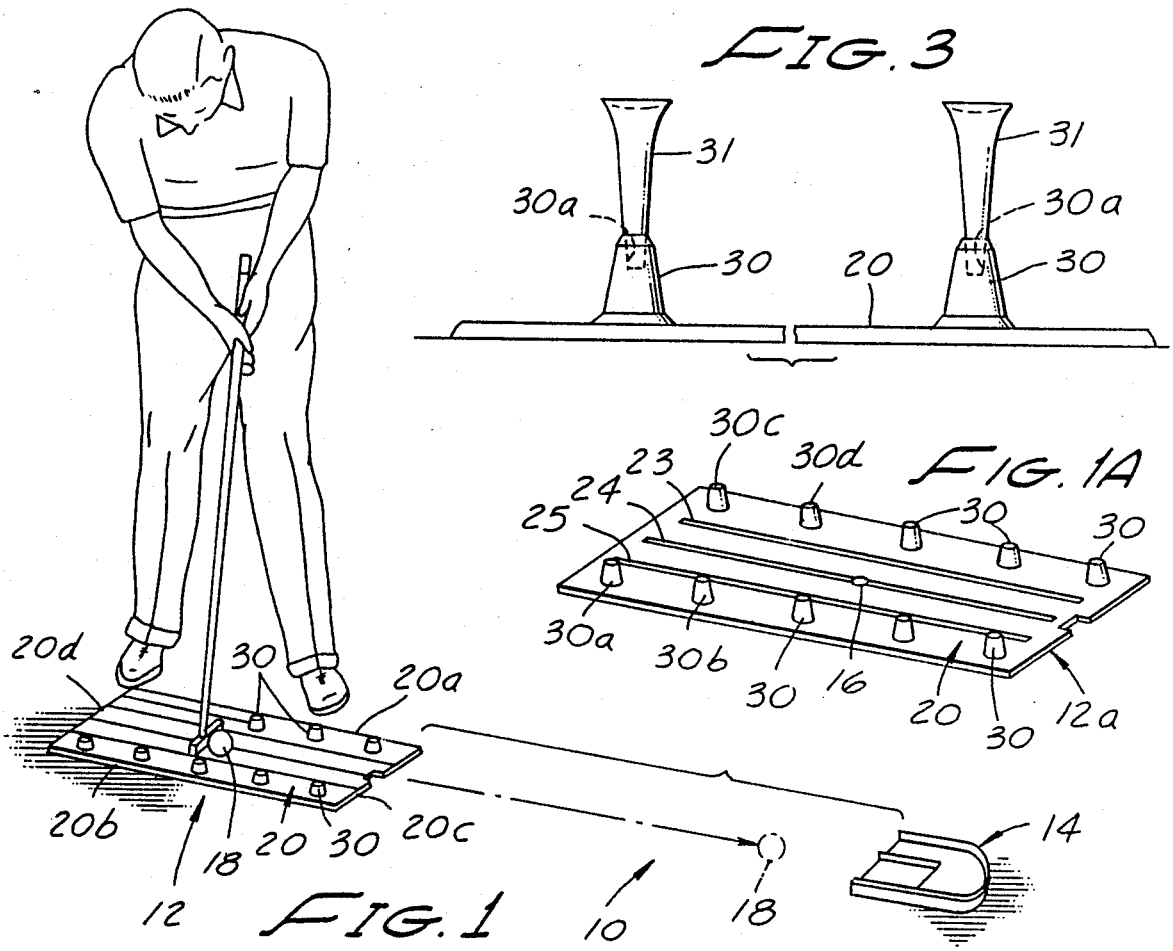
FIG. 1
FIG. 3
FIG. 1A
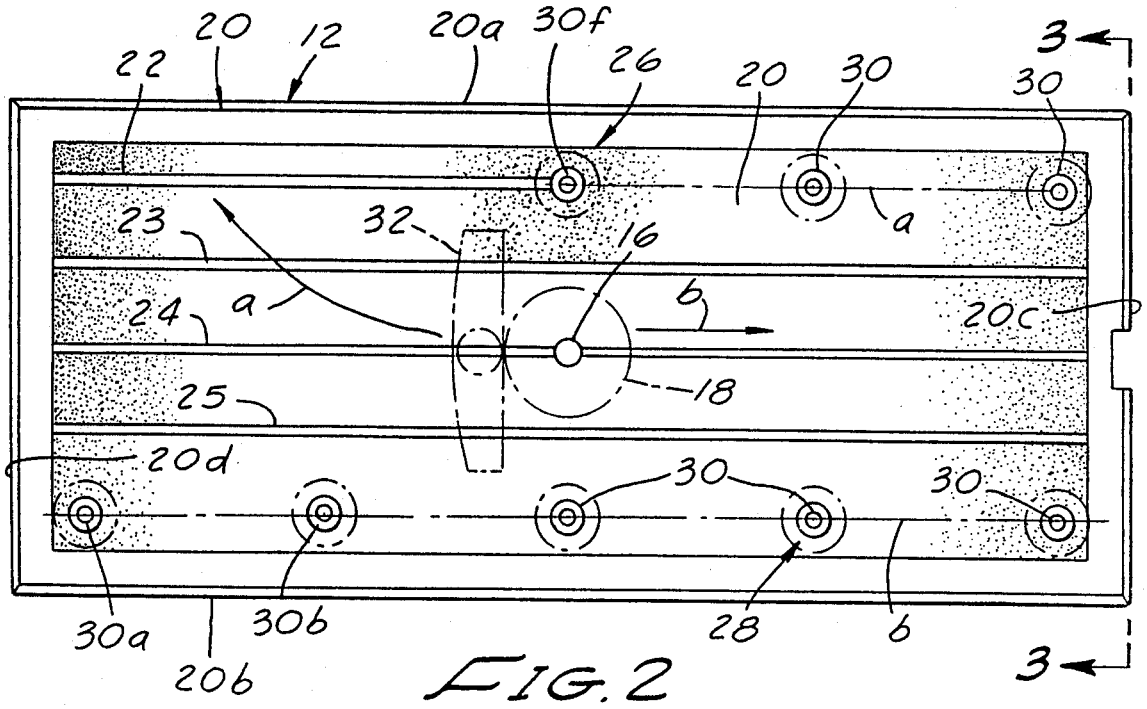
FIG. 2

FIG. 7
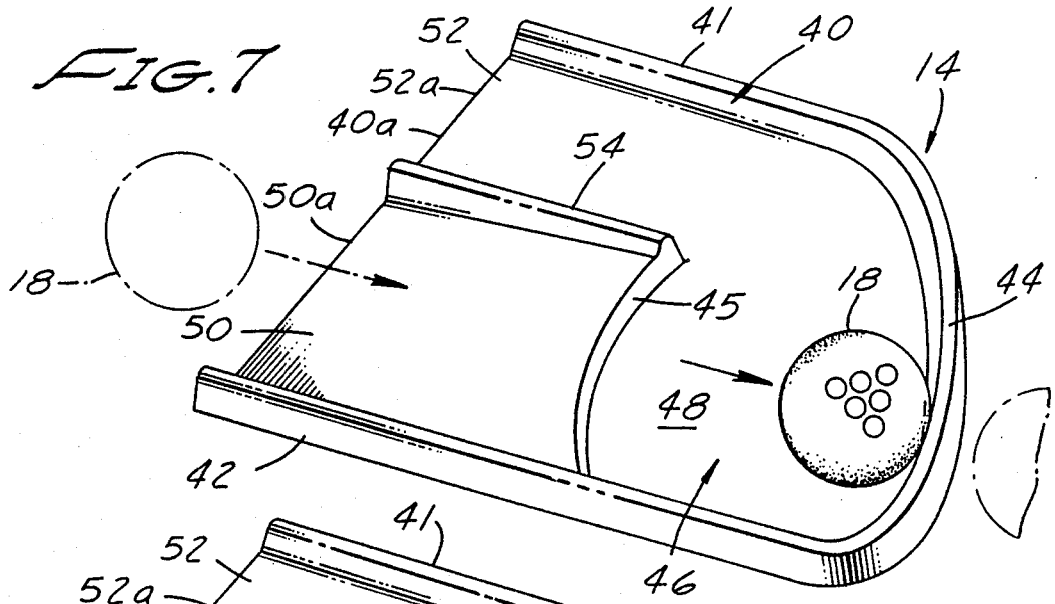
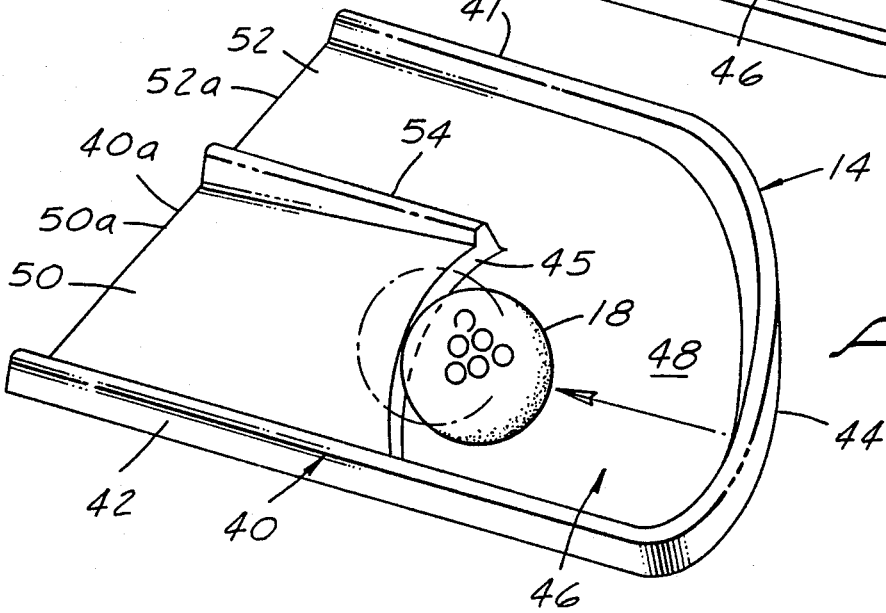
FIG. 7A
FIG. 7B
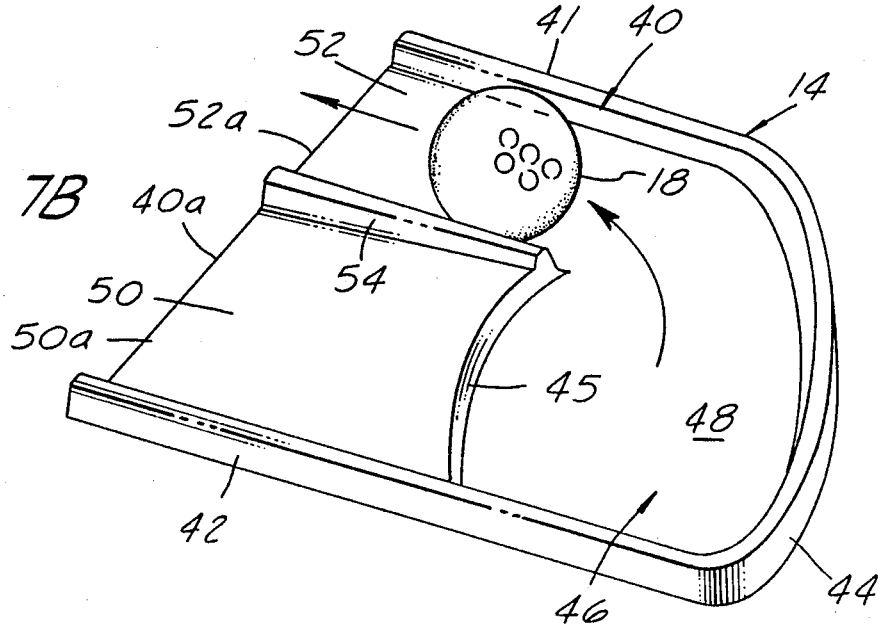

PUTTING PRACTICE DEVICE

This is a division of application Ser. No. 922,705 filed Oct. 24, 1986 which has matured into U.S. Pat. No. 4,725,063.

BACKGROUND OF THE INVENTION

1. Field of the Invention

This invention relates to a device used to practice putting, and particularly to a device having two stations, one serving to assist the user in controlling the direction of the ball being putted, the other to assist the user in controlling the velocity at which the ball is being putted.

2. Background Discussion

A golfer is faced with two challenges when putting a ball. One, to accurately control the direction of the ball; the other, to control its velocity. The direction is primarily controlled by the sweep of the head of the putter as it strikes the ball. The velocity of the ball is controlled by the speed at which the putter's head strikes the ball.

The objective of this invention is to assist the golfer in controlling the direction of the club head as it strikes and then moves through the ball and to signal to the golfer when the force with which the ball is struck is excessive. There are many devices which are used to assist in putting, but none have the desirable features of the present invention which are discussed subsequently.

MAJOR FEATURES OF THE INVENTION

The problem of controlling both the direction and velocity of a putted ball is addressed by the present invention which provides a practicing device which enables the user to develop a good putting stroke. There are several features of this invention which contribute to the improved putting stroke, no single one of which is solely responsible for this desirable attribute. Without limiting the scope of this invention as expressed by the claims, some of its more prominent features will now be discussed briefly. After considering this discussion, and particularly after reading the section of the application entitled: "DETAILED DESCRIPTION OF THE DRAWING," one will understand how the features of this invention assist a golfer in developing a better, more consistent putting stroke.

The first major feature of this invention is the use of two stations. One station is the putting station used to guide the head of the putter. The other station, remote from the first station, is the target at which the putted ball is directed. This second station is specifically designed to indicate to the user when the velocity of the ball is excessive.

The second feature of this invention is that each station may be used independently of the other, each station having its own unique and desirable characteristics. In other words, though desirable, it is not necessary that both stations be used together.

The third feature is that the putting station is designed to guide the club head of the putter between a series of spaced apart posts which indicate to the user the path of travel for the club head. If the club head deviates from this path, it will strike one of the posts. Though not required, each post has a cavity in its top portion which allows the user to insert a tee. This will extend the height of the post and these tees are easily knocked from the post if struck by the head of the putter, further indicating when the swing is inaccurate.

As will be discussed in greater detail below, the putting station includes strips on the flat surface of a flexible mat on which the posts are carried. These strips are aligned in parallel, spaced apart, and seated between the two rows of posts. The strips provide a visual guideway to assist the user in directing the club head through the desirable path, both on the backswing and follow-through. A ball marker is located on the central strip on which the ball is placed.

In accordance with an important alternate feature of this invention, one row of posts is shorter than the other row of posts, allowing the club head to be moved rearwardly and towards the golfer. This is characterized as an inside to outside golf swing.

The target station includes a member having a body including an entry ramp, a collector station having a forward lip and a rear lip, and an exit ramp. The floor of the collector section is tilted to slope downwardly and it merges with the exit ramp at the elevated end of this ramp. Preferably, the body member of the target section is made of a shock absorbent material such as rubber or polyvinylchloride.

Both the entry ramp and exit ramp have their respective ingress and egress portions located at the leading edge of the body member. This leading edge faces the putting station. The two ramps are adjacent each other and a partition separates them. The entry ramp serves as the target.

Assuming the ball is correctly stroked so that it moves into the ingress section of the entry ramp, it will roll up the entry ramp and off the edge of this ramp which is coextensive with the forward lip of the collector section. The rear lip of the collector section is designed so that, if the ball is traveling at the correct velocity, it will strike this lip and be retained, momentarily, in the collector section. If the speed of the ball is excessive, it will roll over the rear lip. This provides a visual indication to the user that excessive force was used in striking the ball. If the ball enters the collector section at the correct velocity, it will strike the rear lip and either bounce back or strike the forward lip and then roll unto the exit ramp.

The embodiments of this invention illustrating all its features will not be discussed in detail. These embodiments show the invention being used by a golfer practicing putting. Although the use of the putting station and the target station are illustrated together, as mentioned above, these two stations could be used independently of each other.

BRIEF DESCRIPTION OF THE DRAWINGS

The drawing, where like numerals indicate like parts, depicts the different embodiments of this invention, in which:

FIG. 1 is a perspective view illustrating a golfer using the two stations of this invention in conjunction with one another.

FIG. 1A is a perspective view of a second embodiment of the putting station of this invention.

FIG. 2 is a plan view of the embodiment of the putting station of this invention as shown in FIG. 1.

FIG. 3 is an end view of the putting station shown in FIG. 1 taken along line 3—3 of FIG. 2.

FIG. 7 is a perspective view of the target station of this invention, with a ball striking the rear lip of this station.

FIG. 7A is the same perspective view as shown in FIG. 7 with the ball, after striking the rear lip, bouncing backward to strike the forward lip of the collector station.

FIG. 7B is the same perspective view as shown in FIG. 5 with the ball rolling down the exit ramp.

DETAILED DESCRIPTION OF THE DRAWING

Figure 4:
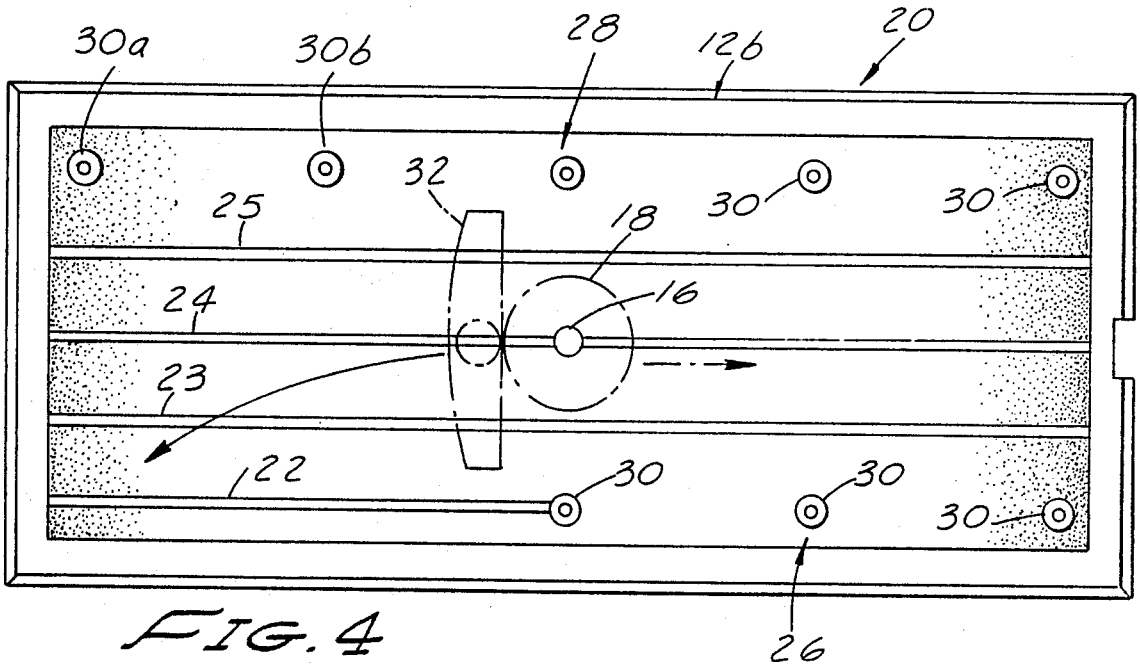
FIG. 4 is a plan view of a third embodiment of the putting station of this invention.

As shown in FIG. 1, the device 10 of this invention includes a putting station 12 and a target station 14. These two stations 12 and 14 are placed apart from one another on a suitable putting surface such as carpeting. The distance between these two stations is optional and can be adjusted by the user. Thus, the user can practice putts of different lengths. The target station 14 is aligned with the putting station 12 so that, as the putted ball leaves the putting station, it will roll toward the target station. The user stands off to one side of the putting station and addresses the golf ball 18 which is placed on a marker 16 (FIGS. 2–6) carried centrally on the surface of the putting station. This marker 16 is simply a depression in the surface on which the golf ball 18 rests.

As best illustrated in FIGS. 2, 3 and 4, the putting station 12 consists of a flexible rectangular shaped mat 20, preferably made out of a plastic such as polyvinylchloride. This mat 20 can be injection molded and is inexpensive to manufacture. Preferably the opposing sides 20*a* and 20*b* of the mat are longer than the opposing sides 20*c* and 20*d*. A series of parallel strips 22, 23, 24 and 25 run lengthwise on the mat's surface, with one strip 24 passing through the central section of the mat. The strip 22 is shorter than the strips 23 through 25 and terminates at post 30*f*. The strip 24 is coextensive with the longitudinal axis of the mat 20 and the strips 23 and 25 straddle this strip 24 and are spaced apart a distance approximately equal to the "sweet spot" of the head of a conventional putter. The mat 20 is preferably a green color and the strips are preferably white. The ball marker 16 is located on the central strip 24 about midway along this strip's length. FIG. 2 shows a putting station 12 for a righhanded golfer. In this embodiment there are two rows 26 and 28 of elevated posts 30 which project upwardly from the surface of the mat 20. Preferably, each of the posts 30 includes a cavity 30*a* in the top to allow a tee 31 to be placed in the post to extend the effective height of these posts. This aspect of the invention will be discussed in greater detail below. The row 26 includes three posts 30 spaced apart and aligned with each other along a line (a) that is parallel to the strips 23 through 25. The individual posts 30 of the two rows oppose one another, except post 30*a* and 30*b* in row 28 do not have opposing posts in row 26. This is an important feature of the invention, providing an imbalance in the number of posts. The unequal numbering posts provide an entryway for the putter head to move into and from, when an inside to outside stroke is used.

In FIG. 1A the putting station 12*a* is identical to that shown in FIG. 1, except the strip 22 is eliminated and two posts 30*c* and 30*d* are molded into the mat 20 in its place. These extra posts 30*c* and 30*d* are directly opposite posts 30*a* and 30*b*. This prevents the head 32 moving from inside to outside, which may be desired by some golfers.

FIG. 4 shows the alternate embodiment of the putting station 12*b* designed for a lefthanded golfer. It has the same configuration generally as the putting station 12 except the posts 30 are arranged to accommodate a lefthanded golfer. In other words the golfer always stands facing the row 26 of posts containing the fewer number, so that the club head can be drawn towards the body of the golfer in an inside-outside type golf swing.

Figure 5:
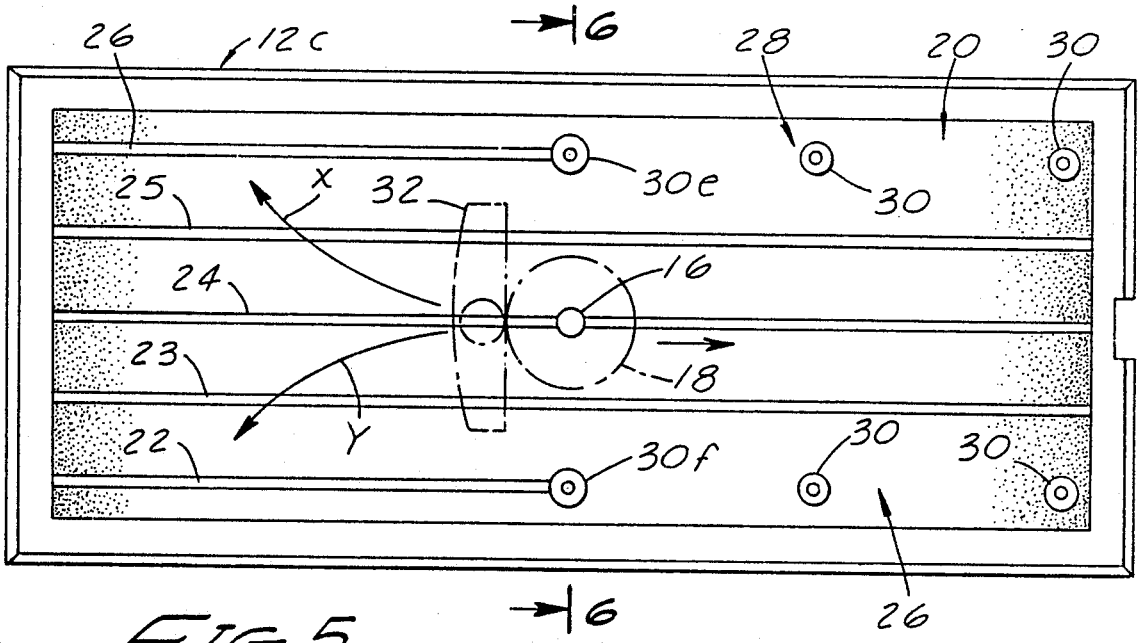
FIG. 5 is a plan view of a fourth embodiment of the putting station of this invention.
Figure 6:
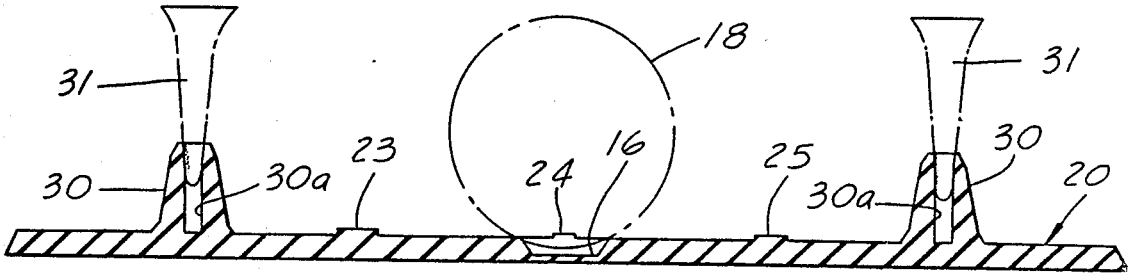
FIG. 6 is a cross-sectional view taken along line 6—6 of FIG. 5.

FIG. 5 illustrates a third embodiment of the putting station 12*c* designed to accommodate either a lefthanded or righthanded golfer. In this embodiment the number of posts 30 in each row 26 and 28 are equal and each containing only 3 posts, with the ball marker 16 being aligned opposite the pair of rear posts 30*e* and 30*f*. An additional strip 26 is placed on the mat's surface in alignment with row 28 and posts 30. The putter head 32 is placed behind the ball 18 and may be moved in either direction, as indicated by arrows x and y, depending upon whether the golfer is righthanded or lefthanded.

Figure 10:
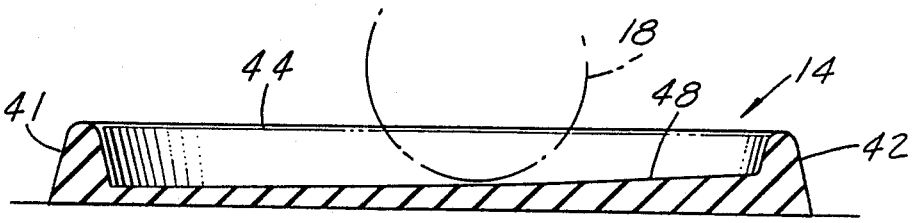
FIG. 10 is a cross-sectional view taken along line 10—10 of FIG. 9.
Figure 11:
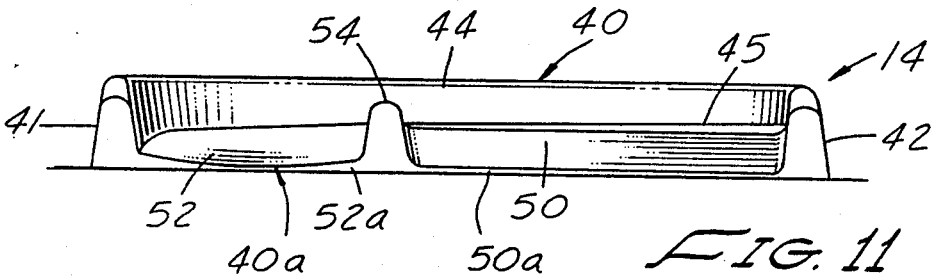
FIG. 11 is a front elevational view taken along line 11—11 of FIG. 8.

The target station 14, which is best illustrated by FIGS. 7 through 11, is molded from a suitable plastic such as polyvinylchloride and is an integral structure. It includes a body member 40 having two parallel sides 41 and 42 which are joined together at opposed ends by a lip 44. This lip 44 constitutes the rear lip of a collector section 46. The collector section 46 also have a forward lip 45 and a floor 48 that is tilted on an angle with respect to the horizontal that allows a golf ball to roll downwardly (FIG. 10). There are two ramps 50 and 52 in communication with the collector station 46. One ramp 50 is the entry ramp which has its leading edge 50*a* coextensive of the leading edge 40*a* of the body member 40. This is the ingress end 50*a* of the ramp 50 and the ramp slopes upwardly from this end 50*a*, terminating at the forward lip 45 of the collector station. The exit ramp 52 has its egress end 52*a* coextensive with the leading edge 40*a* of the body member. This ramp 52 slopes upwardly with its elevated end merging with the floor 48 of the collector section 46. The two ramps 50 and 52 are generally parallel to one another and are separated by a partition 54.

In accordance with the principal feature of the target station 14, the rear lip 44 is designed to stop the golf ball 18 if the ball is traveling at the correct speed, but allow the golf ball to ride over it if it is going too fast. As a general rule, if the velocity of the ball would carry the ball past the site of the station 14 by more than 12 to 15 inches it is going too fast. If the ball 18 struck a golf hole at this speed, it would not drop in but simply glide over it. The target station 14 is designed to take this into consideration, with the dimensions of the station being carefully controlled so that, if the ball is going at a speed which would carry it beyond the station by more than 12 to 15 inches, it will roll over the rear lip 44. Although the dimensions of this device can be varied without departing from this invention, the following dimensions are presented to illustrate one example of this feature of the invention.

Figure 8:
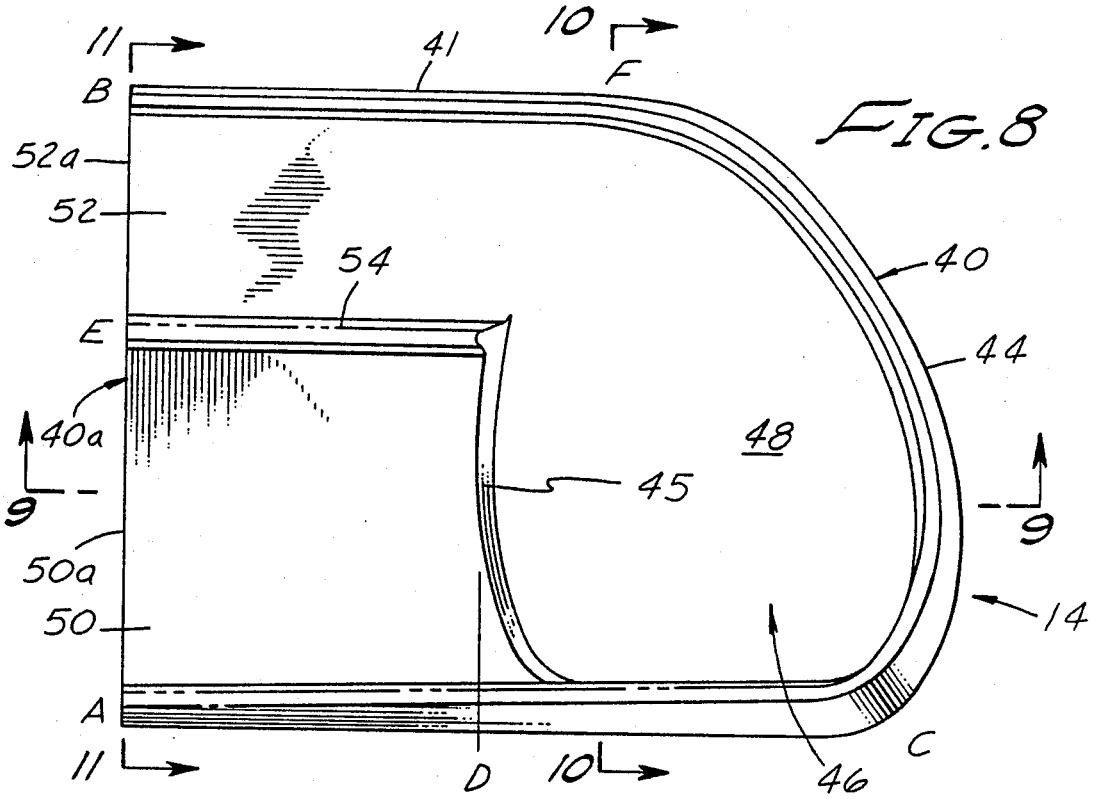
FIG. 8 is a plan view of the target station of this invention.
Figure 9:
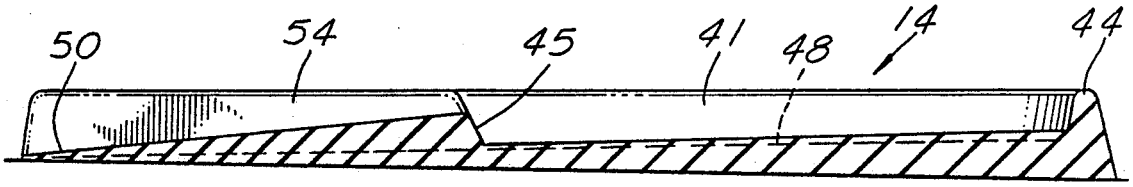
FIG. 9 is a cross-sectional view taken along line 9—9 of FIG. 8.

Referring to FIG. 8, the leading edge 40*a* of the body member from points A to B is about $5\frac{1}{2}$ inches. The length of the body member from points A to C is about $7\frac{3}{4}$ inches. The length of the entry ramp 50 as measured from points A to D is about $3\frac{1}{2}$ inches and the width of the ingress section of the entry ramp is about 3 inches as measured from points A to E. The egress section is the exit ramp, as measured from points E to B, is about $1\frac{3}{4}$ inches. The straight section of the one sidewall as measured from points B to F is about 5 inches. The rear lip 44 curves in an arc from point F to C. As measured on the outside of the lip 44, its height is about $\frac{3}{4}$ of an inch and the inside of the lip from the floor 48 of the collector section 46 to the top edge of the lip 44 is about $\frac{3}{8}$ of an inch. The height of the forward lip 45 as measured from the floor 48 of the collector section 46 to the elevated end of the entry ramp 50 is about $\frac{3}{4}$ of an inch. The top edges of the sides 41 and 42 and partition 54 lie in the same slightly upwardly sloping plane.

To use the device 10 of this invention, the golfer places the putting station 12 and the target station 14 apart from each other in the relative positions illustrated in FIG. 1. Depending on whether the golfer is right-handed or lefthanded, and is employing an inside to outside stroke, he uses either the putting station illustrated in FIGS. 2 or 4, or he could use the putting station 12*c* illustrated in FIG. 5. If he uses a straight backward and forward stroke, he would use the putting station 12*a* illustrated in FIG. 1A. The putting station 12 illustrated in FIG. 2, however, will be discussed.

The golfer places the golf ball 18 on the marker 16 and then stands along the edge 20*a* of the mat 20 facing the ball next to row 26 having a fewer number of posts 30. He strokes the ball, bringing the club backward, swinging it towards the inside as illustrated by the arrow "a" shown in FIG. 2 and then towards the ball and along the straight line indicated by the arrow "b". Optionally, he may place tees 31 in each of the cavities 30*a*. These tees 31 can be easily knocked down if he moves the putter in an erratic manner outside of the pathway defined by the strips 23 through 25 on the surface of the mat. The objective of the golfer is to move the club head 32 along the path between the outside strips 23 and 25, striking the central portion of the face of the putter (the "sweet spot.") Since there is not an equal number of posts 30, there is a space provided which allows the golfer to move the putter backwardly towards the inside. The strip 22 gives the golfer a point of reference as he moves the club head rearwardly and towards the inside, across this strip. When the golfer strikes the ball 18, he will follow through, controlling his swing so that the club head 32 has moved between the opposed rows 26 and 28 of posts 30. As the ball 18 rolls between the rows 26 and 28, he will be able to observe if it deviates from the central strip 24.

If the golfer has correctly stroked the ball 18, it will move into ingress end 50*a* of the entry ramp 50, roll over the forward edge 40*a* and be captured momentarily in the collector section 46 as illustrated in FIG. 7. Assuming the ball is not moving at an excessive speed, the rear lip 44 of the collector section 46 will act as a stop and the ball will bounce off this lip and move in the opposite direction until it strikes the forward lip 45 as illustrated in FIG. 7A. Since the floor of the collector section 46 is tilted towards the exit ramp 52, the ball 18, acting under the influence of gravity, will roll to the side and onto the exit ramp and either remain off to the side or roll down the exit ramp,; clearing the collector section for the next ball. If the ball 18 is moving at an excessive speed, it will ride over the rear lip 44 and not be captured by the collector section. This indicates to the user that he has stroked the ball with too great a force and needs to correct his swing.

SCOPE OF THE INVENTION

The above description presents the best mode contemplated in carrying out the present invention as depicted by the various embodiments disclosed. The combination of the features illustrated by these embodiments provide the user with an improved putting stroke and a way of correcting the stroke for both ball direction and ball velocity. This invention is, however, susceptible to both modifications and alternate constructions from the embodiments shown in the drawing and described above. Consequently, it is not the intention to limit it to the embodiments disclosed. On the contrary, the intention is to cover all modifications and alternate constructions falling within the scope of this invention as generally expressed by the following claims.

I claim:

1. A device used to practice putting by assisting a user to guide the head of a putter including:

a mat providing a generally flat surface having a ball position marker on which a golf ball is placed, a series of post members aligned in two spaced apart rows on opposite sides of the ball position marker wherein one row of post members has a fewer number of members than the other row so that a space is provided for stroking the ball with an inside to outside stroke, with no other structure extending upwardly from the mat between said two rows of post members to thereby provide a guideway between said rows for the putter, and elongated guides on the surface for assisting the user to control the direction of movement of the club head as the ball is struck.

2. The device of claim 1 wherein the ball said ball position marker is centrally located on the mat so that there are post members both forwardly and rearwardly of the marker.

3. The device of claim 1 wherein the elongated guides are a different color than the mat surface to provide a visual indication to the user of the path of the club head as it strokes the ball.

4. The device of claim 1 wherein there are cavities in the tops of the post members in which golf tees may be inserted.

5. A device used to practice putting comprising:

a first station including a mat providing a generally flat surface having a ball position marker on which a golf ball is placed, a series of post members aligned in two spaced apart rows on opposite sides of the ball position marker wherein one row of post members has a fewer number of members than the other row so that a space is provided for stroking the ball with an inside to outside stroke, with no other structure extending upwardly from the mat between said two rows of post members thereby to provide a guideway between said rows for the putter, and elongated (strip-type) guides on the surface for assisting the user to control the direction of movement of the club head, and a second station remote from the first station for catching a golf ball leaving the first station, said second station being an integral structure and including, a body member adapted to rest on a horizontal surface and including a leading edge, a pair of side walls, one side wall at each end of the leading edge and extending rearwardly from the leading edge, said side walls at their rearward ends being joined together by a rear lip, and a collector station in the rearward portion of the body member, an entry ramp and an exit ramp in a side-to-side relationship with a partition wall separation said ramps, said entry ramp serving as a target for the ball and having an entry end coextensive with the leading edge and an exit end terminating at a forward lip which is adjacent and forward to the collector station, said entry end of the entry ramp being lower than the exit end of the entry ramp when the body member is horizontal, said collector station including a generally flat floor which is below both the forward lip and rear lip and has a rear edge which abuts the rear lip, said floor being tilted to allow a ball under the force gravity to roll from the collector station onto the exit ramp when the body member is resting on a horizontal surface, with the forward lip being below the rear lip and the rear lip being of a height that stops the forward movement of the ball if it is not exceeding a predetermined speed, but allows the ball to roll over said lip if the ball exceeds said speed.

6. The device of claim 5 wherein the ball position marker is centrally located on the mat so that there are post members both forwardly and rearwardly of said ball position.

7. The device of claim 5 wherein the elongated guides are a different color than the mat surface to provide a visual indication to the user of the path of the club head as it strokes the ball.

8. The device of claim 5 wherein there are cavities in the tops of the post members in which golf tees may be inserted.

* * * * *